US009441478B2

(12) United States Patent
Ludwig et al.

(10) Patent No.: US 9,441,478 B2
(45) Date of Patent: Sep. 13, 2016

(54) CONVEYING DATA FROM A WELLBORE TO A TERRANEAN SURFACE

(71) Applicant: Halliburton Energy Services, Inc., Houston, TX (US)

(72) Inventors: Wesley Neil Ludwig, Fort Worth, TX (US); Tony Forbes Grattan, Mansfield, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 268 days.

(21) Appl. No.: 14/238,714

(22) PCT Filed: Feb. 12, 2013

(86) PCT No.: PCT/US2013/025733

§ 371 (c)(1),
(2) Date: Feb. 12, 2014

(87) PCT Pub. No.: WO2014/126549

PCT Pub. Date: Aug. 21, 2014

(65) Prior Publication Data

US 2015/0240626 A1 Aug. 27, 2015

(51) Int. Cl.

| | |
|---|---|
| ***E21B 47/00*** | (2012.01) |
| ***E21B 47/01*** | (2012.01) |
| ***E21B 47/12*** | (2012.01) |
| ***E21B 43/1185*** | (2006.01) |

(52) U.S. Cl.

CPC ..... *E21B 47/122* (2013.01); *E21B 43/11855* (2013.01); *E21B 47/00* (2013.01); *E21B 47/01* (2013.01)

(58) Field of Classification Search

CPC ..... E21B 4/18; E21B 47/00; E21B 17/1021; E21B 17/1078; E21B 47/01; E21B 47/122

See application file for complete search history.

(56) References Cited

U.S. PATENT DOCUMENTS

| | | | | |
|---|---|---|---|---|
| 4,252,190 | A * | 2/1981 | Jageler | E21B 19/09 166/250.01 |
| 4,519,585 | A * | 5/1985 | Furrow | B66D 1/50 254/273 |
| 5,197,547 | A * | 3/1993 | Morgan | E21B 23/006 166/181 |
| 5,429,190 | A * | 7/1995 | Kilgore | E21B 23/006 166/113 |

(Continued)

OTHER PUBLICATIONS

International Search Report/Written Opinion issued Oct. 18, 2013 for PCT/US2013/025733 filed Feb. 12, 2013, by KIPO Authorized Officer Lee Jong Kyung, 18 pages.

(Continued)

*Primary Examiner* — Daniel P Stephenson

(74) *Attorney, Agent, or Firm* — Scott Richardson; Parker Justiss, P.C.

(57) ABSTRACT

A well tool includes a housing, an electronic controller, and a drag assembly. The electronic controller is at least partially enclosed within the housing and adapted to determine a status of a downhole wellbore operation. The drag assembly is coupled to the electronic controller and, based on the determination of the electronic controller, adapted to engage with a downhole tubular to generate a drag force on the well tool during movement of the well tool through the tubular. The electronic controller is operable to selectively control the drag assembly to engage with the downhole tubular to generate a plurality of unique drag forces based on a status of the wellbore operation. The plurality of unique drag forces are generated in a substantially repeating pattern.

21 Claims, 4 Drawing Sheets

(56) References Cited

U.S. PATENT DOCUMENTS

| | | | | |
|---|---|---|---|---|
| 6,378,627 | B1 | 4/2002 | Tubel et al. | |
| 6,536,519 | B1 | 3/2003 | Vaynshteyn et al. | |
| 7,392,859 | B2 * | 7/2008 | Mock | E21B 4/18 175/51 |
| 7,886,834 | B2 | 2/2011 | Spencer et al. | |
| 8,485,278 | B2 * | 7/2013 | Mock | E21B 4/18 175/325.1 |
| 2010/0012383 | A1 * | 1/2010 | Drenth | E21B 25/02 175/246 |
| 2010/0243232 | A1 | 9/2010 | Zimmerman et al. | |
| 2011/0048702 | A1 | 3/2011 | Jacob | |
| 2015/0240626 | A1 * | 8/2015 | Ludwig | E21B 3/11855 166/250.01 |

OTHER PUBLICATIONS

PCT International Preliminary Report on Patentability, PCT/US2013/025733, Aug. 27, 2015, 14 pages.

* cited by examiner

CONVEYING DATA FROM A WELLBORE TO A TERRANEAN SURFACE

BACKGROUND

This disclosure relates to a well tool for use in subterranean well systems.

Due to the remote proximity of a well tool or other subterranean device when conveyed into a wellbore (e.g., 12,000-20,000 feet or more below the surface), well operations involving the well tool (e.g., explosives and pyrotechnic devices) rely on monitoring and observing a variety of surface events to verify that the tool has functioned as intended. This can prove difficult in many applications due to the complexity of the wellbore and specific application of the tool being used. In many applications, there is little or no positive indications that the well tool or other subterranean device has functioned as intended, and it is only when the tool is recovered to the terranean surface that the tool can be verified to have functioned correctly. In the event where the well tool or other device is recovered to the surface and it has not functioned correctly, this can introduce additional job site hazards.

DETAILED DESCRIPTION

Figure 1:
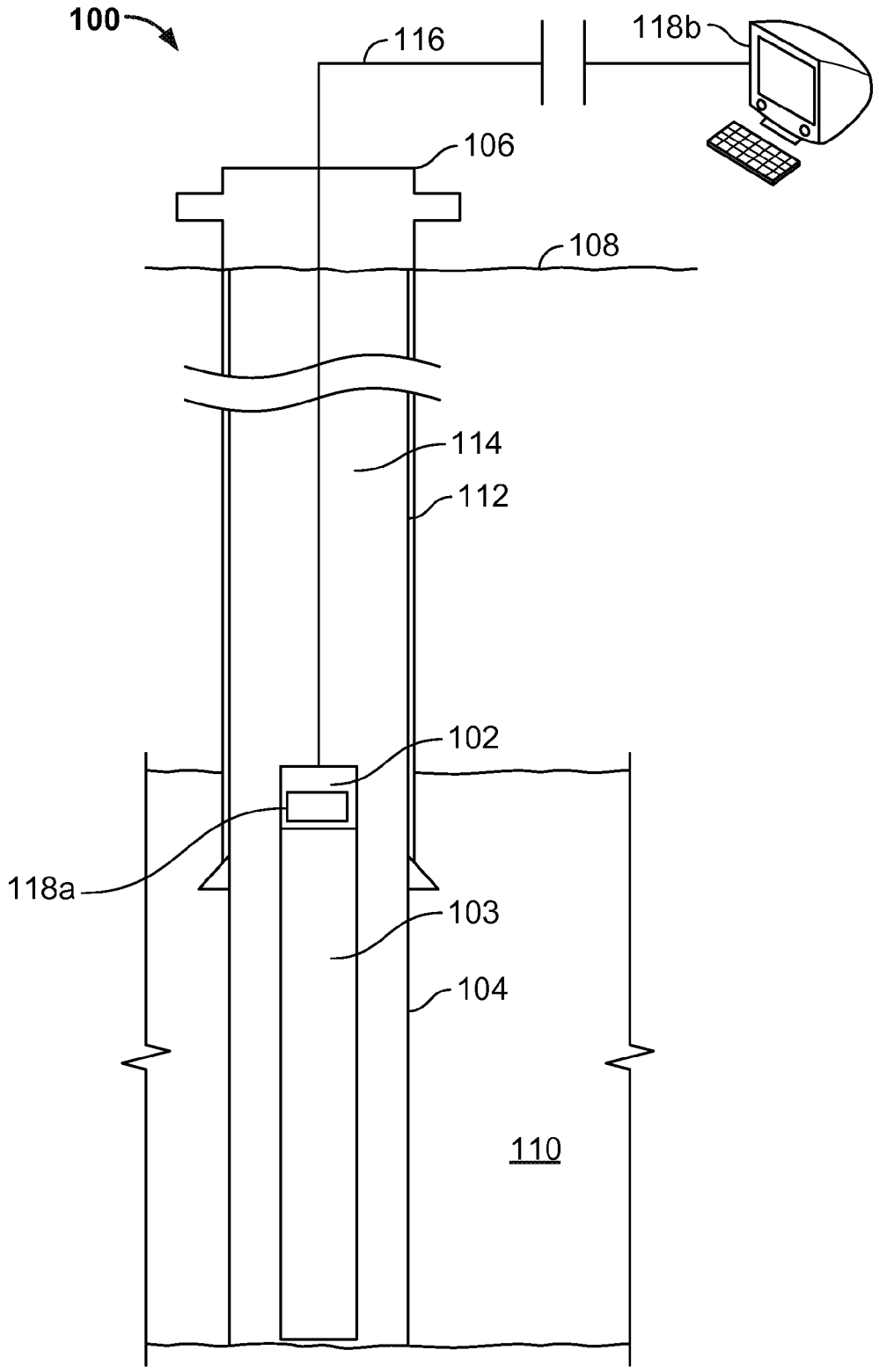
FIG. 1 illustrates a side view of an example well system that includes a well tool string that includes an indicator sub.

In one general implementation of a well tool according to the present disclosure, the well tool includes a housing; an electronic controller at least partially enclosed within the housing and adapted to determine a status of a downhole wellbore operation; and a drag assembly coupled to the control assembly and, based on the determination of the electronic controller, adapted to engage with a downhole tubular to generate a drag force on the well tool during movement of the well tool through the tubular.

In a first aspect combinable with the general implementation, the drag assembly includes a magnetic element positioned near an exterior surface of the housing, and the magnetic assembly adapted to generate a magnetic field near the well tool.

In a second aspect combinable with any of the previous aspects, the magnetic element includes a permanent magnet.

A third aspect combinable with any of the previous aspects further includes a sliding sleeve at least partially attached to the housing and adapted to adjustably expose the permanent magnet in response to the determination of the electronic controller.

In a fourth aspect combinable with any of the previous aspects, the magnetic element includes an electromagnet.

In a fifth aspect combinable with any of the previous aspects, the drag assembly further includes a power conductor that electrically couples the electromagnet to a power source in response to the determination of the electronic controller.

In a sixth aspect combinable with any of the previous aspects, the power source includes a battery enclosed within the housing, the battery coupled to the electronic controller.

In a seventh aspect combinable with any of the previous aspects, the drag assembly includes an extendable arm coupled to the well tool at a proximal end of the arm; a contact element coupled to a distal end of the arm, the contact element adapted to contactingly engage the tubular; and an arm actuator communicably coupled to the electronic controller and the arm, the arm actuator adapted to forcibly extend the arm away from the housing.

In an eighth aspect combinable with any of the previous aspects, the contact element includes a roller.

In a ninth aspect combinable with any of the previous aspects, the drag assembly further includes a power conductor that electrically couples the arm actuator to a power source.

In a tenth aspect combinable with any of the previous aspects, the electronic controller is operable to selectively control the drag assembly to engage with the downhole tubular to generate a plurality of drag forces on the well tool during movement of the well tool through the tubular based on a status of the wellbore operation.

In an eleventh aspect combinable with any of the previous aspects, the plurality of drag forces include at least one of a plurality of unique drag forces generated in a substantially repeating pattern; or a plurality of substantially similar drag forces generated in a unique pattern.

In a twelfth aspect combinable with any of the previous aspects, the housing at least partially encloses a downhole well tool communicably coupled to the electronic controller, and the electronic controller is adapted to determine the status of the downhole wellbore operation from the downhole well tool.

A thirteenth aspect combinable with any of the previous aspects further includes a first connector on a first end that is adapted to couple the well tool to a conveyance extendable to a terranean surface, and a second connector on a second end that is adapted to couple the well tool to a downhole well tool.

In a fourteenth aspect combinable with any of the previous aspects, the electronic controller is adapted to determine a status of the downhole wellbore operation from the downhole well tool coupled to the well tool.

In another general implementation, a method of conveying data from a wellbore to a terranean surface includes identifying, at an indicator sub that is part of a downhole tool string coupled to a conveyance through a wellbore, data that is associated with an operation of the downhole well tool; based on the receipt of the data, actuating a drag assembly of the indicator sub; and adjusting a tension on the conveyance based on actuating the drag assembly as the downhole tool string is moved through the wellbore, the tension associated with the data from the downhole well tool.

In a first aspect combinable with the general implementation, identifying data that is associated with an operation of the downhole well tool includes receiving, at the indicator sub, the data from the downhole well tool in the tool string.

In a second aspect combinable with any of the previous aspects, actuating a drag assembly of the indicator sub includes energizing a magnetic element of the drag assembly; generating a magnetic field adjacent the housing of the indicator sub; and attracting the housing of the indicator sub to a ferrous tubular positioned in the wellbore with the generated magnetic field.

In a third aspect combinable with any of the previous aspects, actuating a drag assembly of the indicator sub includes actuating an arm of the drag assembly based on the receipt of the data; extending the arm of the drag assembly away from the housing; and contacting the arm of the drag assembly with a tubular positioned in the wellbore or a surface of the wellbore.

In a fourth aspect combinable with any of the previous aspects, contacting the arm of the drag assembly with a tubular positioned in the wellbore or a surface of the wellbore includes contacting a roller coupled to the arm against the tubular positioned in the wellbore or the surface of the wellbore.

A fifth aspect combinable with any of the previous aspects further includes actuating a brake to apply a force on the drag assembly; and further adjusting the tension on the conveyance based on the applied force on the drag assembly.

In a sixth aspect combinable with any of the previous aspects, actuating a brake to apply a force on the drag assembly includes actuating a brake to apply a force on the roller coupled to the arm.

A seventh aspect combinable with any of the previous aspects further includes determining that the data received from the downhole well tool includes a first type of data; actuating the drag assembly at a first actuation pattern based on the first type of data, the first actuation pattern including a unique sequence of actuation of the drag assembly and non-actuation of the drag assembly, the tension associated with the first actuation pattern; receiving, at the indicator sub, another data from the downhole well tool, the other data associated with another status or operation of the downhole well tool; determining that the other data received from the downhole well tool includes a second type of data different from the first type of data; actuating the drag assembly at a second actuation pattern different than the first actuation pattern based on the second type of data, the second actuation pattern including a unique sequence of actuation of the drag assembly and non-actuation of the drag assembly; and generating another tension on the conveyance associated with the second actuation pattern.

In an eighth aspect combinable with any of the previous aspects, determining that the data received from the downhole well tool includes a first type of data includes: comparing the data received from the downhole well tool to a plurality of entries in a database stored on the indicator sub; and matching the data to one of the plurality of entries, each entry including a particular type of data.

A ninth aspect combinable with any of the previous aspects further includes determining the first actuation pattern based on matching the data to one of the plurality of entries.

A tenth aspect combinable with any of the previous aspects further includes measuring, at the terranean surface, the adjusted tension on the conveyance; and based on the measurement, determining a status of at least a portion of the downhole tool string.

In another general implementation, a downhole tool assembly includes a downhole tool configured to perform one or more downhole operations; and an indicator sub including a controller at least partially enclosed within a housing of the indicator sub and communicably coupled to the downhole tool; and a power source coupled to the controller; and a drag assembly coupled to the power source and adapted to generate a drag force on the downhole tool assembly during movement of the downhole tool assembly through the tubular.

In a first aspect combinable with the general implementation, the drag assembly includes an electromagnet.

In a second aspect combinable with any of the previous aspects, the drag assembly further includes a power conductor that electrically couples the electromagnet to the power source, and the electromagnet is adapted to generate a magnetic field that attracts the indicator sub to the tubular when the electromagnet is energized by the power source.

In a third aspect combinable with any of the previous aspects, the drag assembly includes an actuator; and a member coupled to the housing and extendable to directly contact the tubular when the actuator is powered by the power source.

In a fourth aspect combinable with any of the previous aspects, the member includes a roller arranged on the member to directly contact the tubular when the actuator is powered.

In a fifth aspect combinable with any of the previous aspects, the indicator sub is integrated with the downhole tool.

Various implementations of an indicator sub in a well tool or tool string according to the present disclosure may include one, some, or all of the following features. For example, the indicator sub may convey information and/or data to a terranean surface regarding an operation (e.g., a status of an operation, outcome of an operation, or otherwise) of one or more other well tools in a well tool string. For instance, the indicator sub may convey information through a conveyance, such as, for example, a slickline, that does not typically convey information or data thereon. As another example, the indicator sub may be preset or preprogrammed to convey particular data streams or sequences to signify particular operations being completed by one or more well tools. In some examples, the indicator sub may convey information in cased and open hole wellbore completions. The indicator sub may also provide confirmation to a system or user located on a terranean surface that a well tool is functioning correctly. Further, the indicator sub may be stand alone in that no electrical power from the terranean surface may be necessary for operation. As another example, may provide real-time feedback of the operation and/or functioning of one or more well tools downhole in a wellbore without waiting for retrieval of such tools to the surface.

FIG. 1 illustrates a side view of an example well system 100 that includes a well tool string that includes an indicator sub 102. In one or more general implementations, the indicator sub 102 may be a standalone well tool or included within a portion of a well tool string or well tool. In some aspects, the indicator sub 102 may convey information indicative of an operation or operations of another well tool (e.g., a tool in the same well tool string as the indicator sub 102) through a conveyance to which the indicator sub 102 is coupled. For example, the indicator sub 102 may increase or decrease a magnitude of drag on the tool string as it is being deployed into or retrieved from the well bore 104. The change in drag magnitude may be manipulated based on one or more signals sent to the indicator sub 102 from another well tool in the tool string. In some aspects, the change in drag magnitude may be sufficient so that it can be detected from the terranean surface 108. In some aspects, manipulating the drag force may include adjusting (e.g., increasing or decreasing) the drag in time variant patterns that can be sensed and decoded to convey data (e.g., tool status or other information) from the downhole well tool to the surface. For example, data such as whether the well tool is functional or not, whether the well tool has completed a particular operation or not, or other information, may be conveyed through variances in the drag magnitude.

The well system 100 is provided for convenience of reference only, and it should be appreciated that the concepts herein are applicable to a number of different configurations of well systems. As shown, the well system 100 includes a substantially cylindrical well bore 104 that forms a borehole 114 that extends from well head 106 at a terranean surface 108 through one or more subterranean zones of interest 110. In FIG. 1, the well bore 104 extends substantially vertically from the surface 108 into the subterranean zone 110. However, in other instances, the well bore 104 can be of another configuration, for example, entirely substantially vertical or slanted, it can deviate horizontally or in another manner than horizontal, it can be a multi-lateral, and/or it can be of another configuration.

The illustrated well bore 104 is lined, at least partially, with a casing 112, constructed of one or more lengths of tubing, that extends from the surface 108, downhole, toward the bottom of the well 104. The casing 112 provides radial support to the well bore 104 and seals against unwanted communication of fluids between the well bore 104 and surrounding formations. Here, the casing 112 ceases at a particular location above the subterranean zone 110 and the remainder of the well bore 104 is an open hole completion, e.g., uncased. In other instances, the casing 112 can extend to the bottom of the well bore 104 or can be provided in another configuration. In some implementations, the casing 114 is constructed of joints of tubulars that are coupled together with collars at the joints.

As illustrated, the downhole assembly (e.g., the indicator sub 102 coupled to the tool string 103) is coupled to a conveyance 116 such as a wireline, a slickline, an electric line, a coiled tubing, straight tubing, or the like. In some implementations, the downhole tool string 103 can be lowered by the indicator sub 102 with the conveyance 116 from the terranean surface 108. In some implementations, the indicator sub 102 may be coupled to the conveyance 116 (e.g., wireline such as slickline) through, for example, a rope socket or other coupling device.

In some implementations, the downhole tool string 103 can be deployed with the indicator sub 102 into the wellbore 104 via a lubricator (not shown) or simply dropped into the wellbore 104. Then gravity may provide or help provide an external force for moving the downhole tool string 103 along at least a partial length of the wellbore 104.

The indicator sub 102 can be actuated by an actuation signal generated by a controller 118*a* located in the sub 102. For instance, the control unit 118*a* may include or comprise an autonomous programmable unit (e.g., PCB, controller, field programmable ASIC, or otherwise) located in the indicator sub 102 uphole of, for instance, a release mechanism of the tool 103. Alternatively, in some implementations, the actuation signal can be sent from a control unit 118*b* to the indicator sub 102 (e.g., electrical signals sent over the conveyance 116). Further, although shown in the illustrated example as located above-ground (e.g., on the terranean surface 108), the control unit 118*b* (or other control system similar to the control unit 118*b*) may be located within the well system 100 (or outside of it) but still communicably coupled to the indicator sub 102 or in another portion of a tool string that includes the indicator sub 102. The control unit 118*b* (like 118*a*) can be a system based on a microprocessor, a mechanical, or an electro mechanical controller. In some implementations, the indicator sub 102 can communicate with the control unit 118*b* located on the terranean surface 108, allowing a user of the control unit 118*b* to actuate the indicator sub 102 (or other downhole tools in the tool string 103) by sending the actuation signal.

As illustrated, the indicator sub 102 can be autonomous and self-actuate without requiring the command of a control unit 118*b* located on the terranean surface 108. The control unit 118*a* may include a timer, secondary controller (e.g., with the control unit 118*a* as the primary controller) or other control mechanism. For example, the control unit 118*a* may be programmable prior to deployment in the wellbore 104 so that the sub 102 could detect one or more operation statuses of a downhole tool in the tool string 103 (e.g., actuation, on/off, battery power, and otherwise). In some instances, detection may include, for instance, a shock load measured by accelerometers or a pressure pulse measured by a dynamic pressure sensor. The indicator sub 102 may have a threshold trigger value relative to such measurements that could be set so that it would not pre-trigger by normal events experienced during tool deployment into the wellbore 104.

The control unit 118*a* in the indicator sub 102 could also be programmed (e.g., through a database or lookup table stored in memory and accessible by a processor of the control unit 118*a* in the indicator sub 102) for actuation by a triggering event from another downhole tool in the string 103. The triggering event may indicate to the indicator sub 102 that the downhole tool has correctly functioned. As yet another example, the control unit 118*a* in the indicator sub 102 could be programmed for actuation once the sub 102 detects upward movement relative to the wellbore 104. Actuation of the indicator sub 102 may occur, therefore, as the tool string 103 is moved through the wellbore 104.

Figure 2:
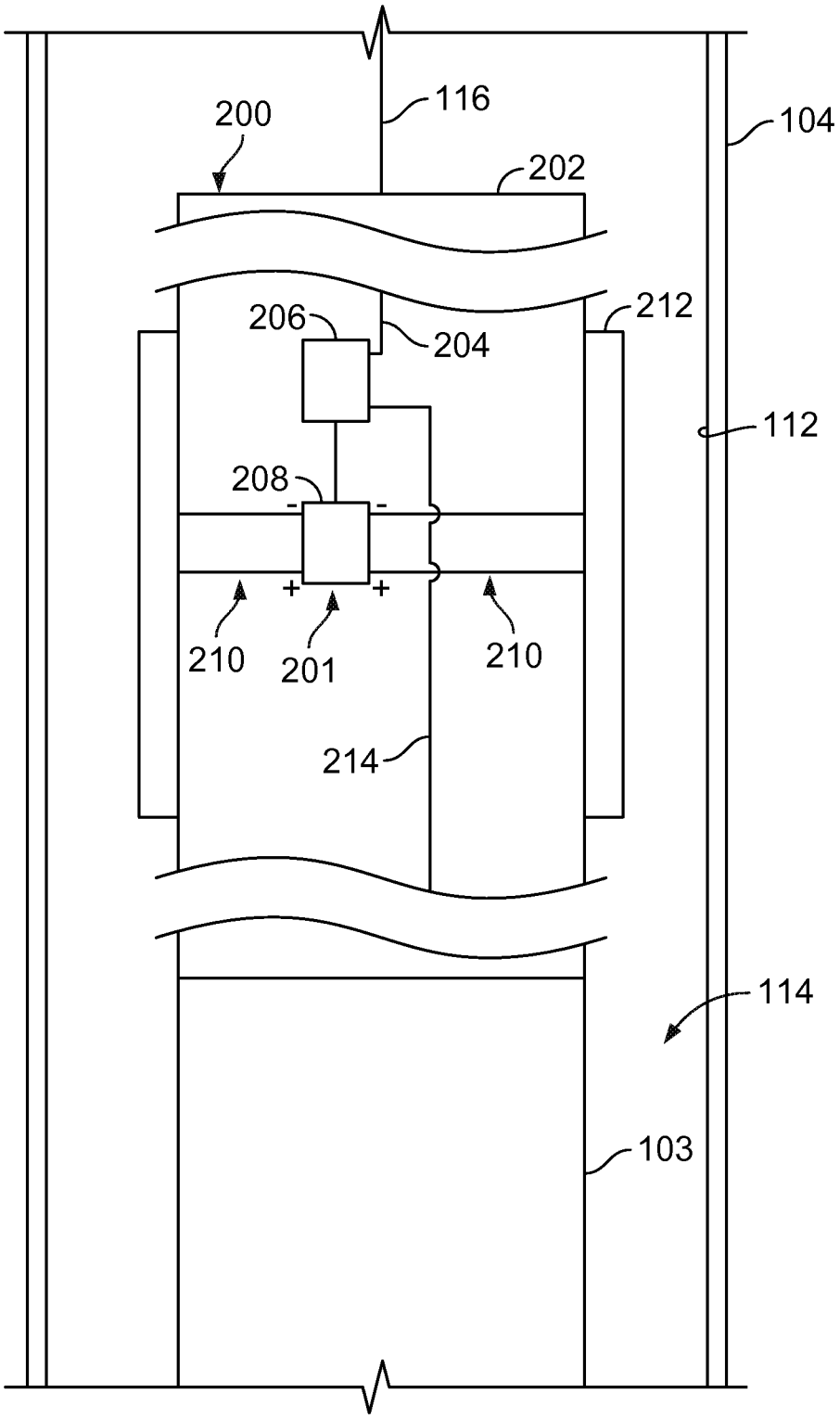
FIG. 2 illustrates an example implementation of an indicator sub.

FIG. 2 illustrates an example implementation of an indicator sub 200. In this illustrated embodiment, the indicator sub 200, generally, includes one or more magnetic elements 212 (e.g., electro-magnets) arranged around a housing 202 of the indicator sub 200 to interact with the casing 112 (e.g., a metal tubular such as steel, iron, or other metal that is magnetic). Alternatively, in some implementations, the magnetic elements 212 may arranged within the housing 202 (e.g., a non-magnetic housing) but are operable to generate a magnetic field that extends to an exterior of the housing 202. For example, in some aspects, the magnetic elements 212 may, when actuated, be attracted to the metal of the casing 112, thereby generating an attractive force that acts as a drag force on the indicator sub 200 as the sub 200 is moved through the borehole 114. One or more components of the sub 200, such as the magnetic elements 212 and an actuation circuit 201, may comprise a drag assembly of the indicator sub 200.

The actuation circuit 201 includes, in the illustrated embodiment, a controller 206, a power source 208, and conductors 210 that electrically couple the power source 208 to the magnetic elements 212. In the illustrated implementation, the actuation circuit 201 may be a stand-alone control unit (e.g., control unit 118*a*) that controls the operations of the sub 200. For example, the controller 206 (e.g., a microprocessor based controller, application specific integrated circuit, or other controller type) may include instructions (e.g., software, hardware or a combination thereof) that are operable to initiate, control, or otherwise manage the operations of the sub 200 and/or the downhole tool 103 (e.g., through a communication element 214).

The controller 206 is coupled to the power source 208 (e.g., battery such as a lithium ion battery or otherwise) and may, in some aspects, control a power output of the power source 208 (e.g., through a switch or otherwise). As the power source 208 is electrically coupled through conductors 210 to the magnetic elements 212, the magnetic elements 212 (e.g., electro-magnets) may be actuated by the power source 208.

In an alternative implementation, the controller 206 is communicably coupled to the conveyance 116 through a communication element 204, and is also communicably coupled to the downhole tool 103 through the communication element 214. Thus, the controller 206, in the alternative implementation, may receive instructions (e.g., signals, data, and otherwise) from the terranean surface 108 as well as the downhole tool 103.

In an alternative implementation, the magnet elements 212 may be powered from the conveyance 116 (e.g., slickline, wireline, or other conveyance) rather than (or in addition to) the power source 208. In such aspects, the power source 208 may be eliminated or may, in some cases, be a backup power source that is energized when power is lost from the conveyance 116.

In operation, the indicator sub 200 may perform one or more operations to, for example, convey data from a downhole tool (e.g., in the downhole tool string 103) to the terranean surface 108. For example, the controller 206 may be preprogrammed with data and/or instructions. As one example, the downhole tool may provide a signal to the controller 206 that indicates, for instance, that an operation has been completed (e.g., an explosive charge being detonated), a status of the tool (e.g., on/off, battery life, and otherwise), a problem with the tool (e.g., malfunction has occurred), or other signal.

The controller 206 may actuate the sub 200, for example, at a specified time, depth, event, or upon receipt of a signal (e.g., from the terranean surface). For instance, the controller 206 may, for instance, actuate the power source 208 to provide power to the magnetic elements 212 (which may be positioned around a circumference of the housing 202 or in other positions on the sub 200). As the magnetic elements 212 are powered, a magnetic field is generated around the indicator sub 200. The magnetic field may be generated to attract the magnetic elements 212, and thus the indicator sub 200, to the metal casing 112 (e.g., in cased wellbores). Due to the attractive force, a drag force may be applied to the indicator sub 200 as the sub 200 is moved through the borehole 114. Such drag force may be detected at the terranean surface 108, for example, through a resistance (e.g., through tension pulses or constant tension) in moving the indicator sub 200 and downhole tool string 103 through the wellbore 104. The drag force, sensed at the terranean surface 108 as tension, can be interpreted through the tension as the data from the downhole tool in the downhole tool string 103.

In some implementations, the magnitude of the drag force that would be imparted to the indicator sub 200 by energizing the magnetic elements 212 may be customized to the particular form of the conveyance 116. For example, heavier conveyances (e.g., coiled tubing or other tubing) may require a larger drag force to ensure that the tension pulses generated at the terranean surface 108 would be detectable. As another example, lighter conveyances (e.g., wireline or slickline) may require a smaller drag force to ensure that the tension is detectable at the surface 108.

In some implementations, the magnetic elements 212 can be energized continuously for a predetermined time duration, periodically at a preset or known frequency, or as one of multiple frequencies with each frequency corresponding to a particular data from the downhole tool. For example, the magnetic elements 212 could be activated in several unique patterns to relay information to the surface 108. For example, one unique pattern may be used to acknowledge receipt of a command at the downhole tool from the surface 108. Another unique pattern may signify that the downhole tool 103 was actuated and/or completed an operation (e.g., perforating gun has fired). Another unique pattern may signify that the downhole tool 103 had a malfunction.

In an alternative implementation, the magnetic elements 212 may be permanent magnets or other form of magnet that are adjustably covered by a sliding sleeve or other covering element. Thus, when the power source 208 is actuated, the sliding sleeve may be adjusted to expose the magnets to the metal casing 212. By adjusting exposure of the magnets to the metal casing 212, the drag force on the indicator sub 200 may be adjusted as described above.

Figure 3:
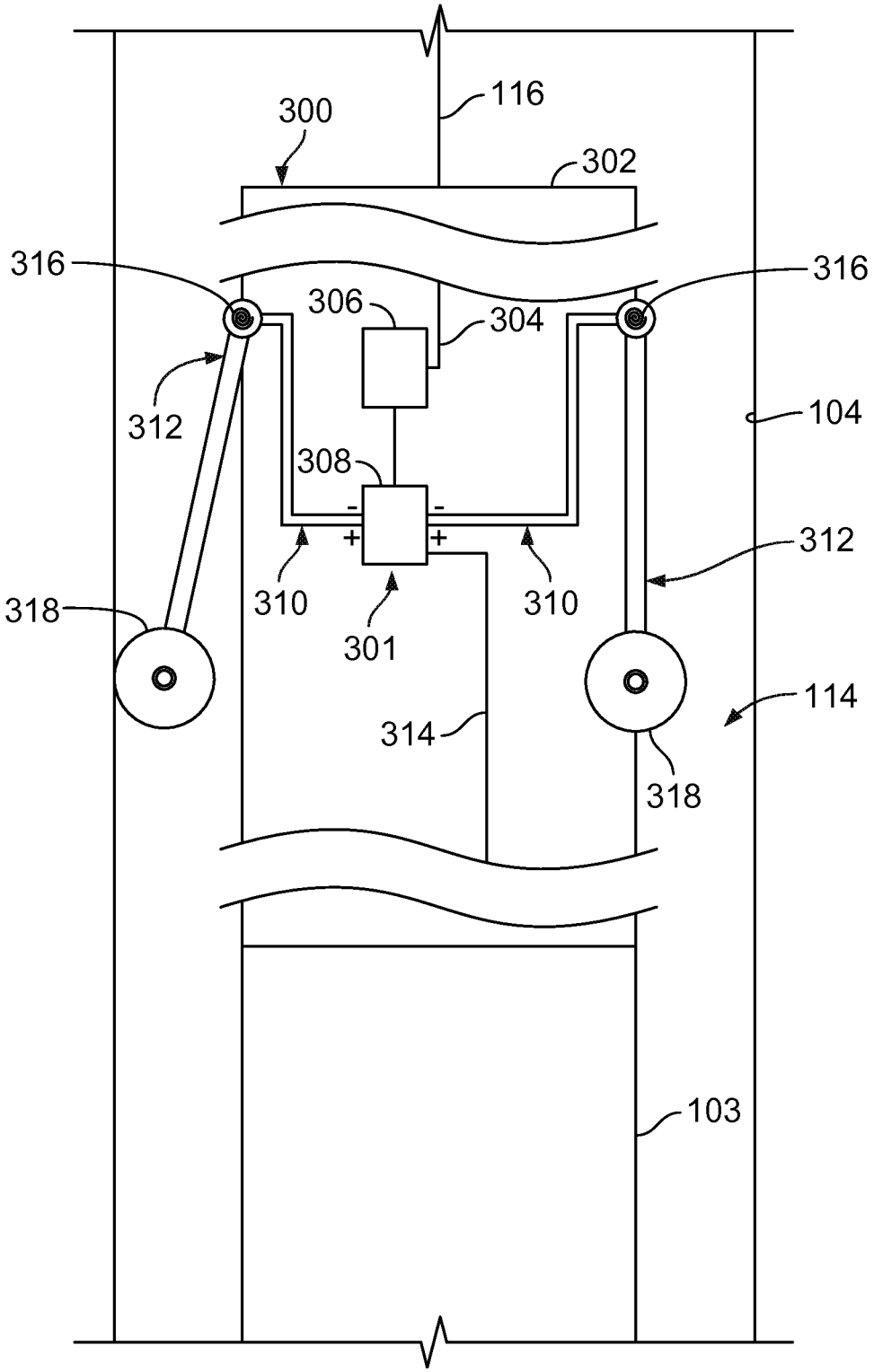
FIG. 3 illustrates another example implementation of an indicator sub.

FIG. 3 illustrates another example implementation of an indicator sub 300. In some implementations, the indicator sub 300 may be utilized in uncased, open hole, and/or non-magnetic cased wellbores. In this illustrated embodiment, the indicator sub 300, generally, includes one or more arms 312 with rollers 318 coupled to a housing 302 of the indicator sub 300 to contactingly engage the wellbore 104. For example, in some aspects, the arms 312 may, when actuated, extend from the housing 302 to engage the rollers 318 with the wellbore 104, thereby generating a drag force on the indicator sub 300 as the sub 300 is moved through the borehole 114. Although illustrated as substantially round wheels, the rollers 318 may be round or another shape that can contactingly engage the wellbore 104 to generate a frictional force that acts on the indicator sub 300. One or more components of the sub 300, such as one or more of the arms 312, rollers 318, arm actuators 316, and the actuation circuit 301, may comprise a drag assembly of the indicator sub 300.

In alternative implementations, the arms 312 may not include rollers 318 coupled to their ends. In such implementations, greater friction may be generated as the arms 312 contact the wellbore 104, thereby generating an increased drag force on the sub 300 (and downhole tool 103) during movement through the borehole 114.

In alternative implementations, the rollers 318 may be inset to the housing 302 without being attached to arms 312 that extend towards the wellbore 104. Force or drag on the indicator sub 300 may be increased through contact between the rollers 318 and the wellbore 104. Additional force or drag on the indicator sub 300 may be generated by applying or actuating brakes that, for example, contact the rollers 318, thereby increasing the tension on the conveyance 116. The brakes may be implemented, however, with rollers 318 mounted on arms 312 or not mounted on arms 312.

The actuation circuit 301 includes, in the illustrated embodiment, a controller 306, a power source 308, and conductors 310 that electrically couple the power source 308 to arm actuators 316. In the illustrated implementation, the actuation circuit 301 may be a stand-alone control unit (e.g., control unit 118*a*) that controls the operations of the sub 300. For example, the controller 306 (e.g., a micro-processor based controller, application specific integrated circuit, or other controller type) may include instructions (e.g., software, hardware or a combination thereof) that are operable to initiate, control, or otherwise manage the operations of the sub 300 and/or the downhole tool 103 (e.g., through a communication element 314).

The controller 306 is coupled to the power source 308 (e.g., battery such as a lithium ion battery or otherwise) and may, in some aspects, control a power output of the power source 308 (e.g., through a switch or otherwise). As the power source 308 is electrically coupled through conductors 310 to the armature actuators 316, the arm actuators 316 may actuate (e.g., extend) the arms 312 when energized.

In an alternative implementation, the controller 306 is communicably coupled to the conveyance 116 through a communication element 304, and is also communicably coupled to the downhole tool 103 through the communication element 314. Thus, the controller 306 in the alternative implementation, may receive instructions (e.g., signals, data, and otherwise) from the terranean surface 108 as well as the downhole tool 103.

In an alternative implementation, the arm actuators 316 may be powered from the conveyance 116 (e.g., slickline, wireline, or other conveyance). In such aspects, the power source 308 may be eliminated or may, in some cases, be a backup power source that is energized when power is lost from the conveyance 116.

In the illustrated implementation, the arm actuators 316 may be powered, spring-loaded actuators that, when energized, extend the arms 312 away from the housing 302 and into contact with the wellbore 104. For example, in some implementations (as shown schematically in FIG. 3), each arm 312 may be pinned to, for example, the housing 302, thereby defining a fulcrum around which the arm 312 may pivot when actuated by an arm actuator 316. The arm actuator 316 may apply a contacting force, when energized, to the arm 312 to urge the arm 312 away from the housing 302 and into frictional contact with the wellbore 104 (e.g., an uncased wellbore). For example, the arm actuator 316 may include a spring-loaded linkage that, when energized, urges the arm 312 and, based on a biasing force exerted by the arm 312 by the arm actuator 316, hold the arm 312 against the wellbore 104.

In operation, the indicator sub 300 may perform one or more operations to, for example, convey data from a downhole tool (e.g., in the downhole tool string 103) to the terranean surface 108. For example, the controller 306 may be preprogrammed with data and/or instructions. As one example, the downhole tool 103 may provide a signal to the controller 306 that indicates, for instance, that an operation has been completed (e.g., an explosive charge being detonated), a status of the tool (e.g., on/off, battery life, and otherwise), a problem with the tool (e.g., malfunction has occurred), or other signal.

Receipt of data or a signal at the controller 306 may actuate the sub 300. For instance, the controller 306 may, for instance, actuate the power source 308 to provide power to the arm actuators 316 (which may be positioned around a circumference of the housing 302 or in other positions on the sub 300). As the arm actuators 316 are powered, the arms 312 (or arm in the case of one) are extended so that arms 312 (or, in some aspects, the rollers 318) contact the wellbore 104 to generate a frictional force on the indicator sub 300. Due to the frictional force, tension is increased in the conveyance 116. Such increased, or change in, tension, may be detected at the terranean surface 108 in moving the indicator sub 300 and downhole tool string 103 through the wellbore 104. The frictional force, sensed at the terranean surface 108 as tension, can be interpreted through the tension as the data from the downhole tool in the downhole tool string 103.

In some implementations, the magnitude of the frictional force that would be imparted to the indicator sub 300 by energizing the arm actuators 316 may be customized to the particular form of the conveyance 116. For example, heavier conveyances (e.g., coiled tubing or other tubing) may require a larger drag force to ensure that the tension pulses generated at the terranean surface 108 would be detectable. In such cases, the arm actuators 316 may more forcibly extend the arms 312 against the wellbore 104 (e.g., through a higher spring force). As another example, lighter conveyances (e.g., wireline or slickline) may require a smaller drag force to ensure that the tension is detectable at the surface 108.

In some implementations, the arm actuators 316 can be energized continuously for a predetermined time duration, periodically at a preset or known frequency, or as one of multiple frequencies with each frequency corresponding to a particular data from the downhole tool. For example, the arm actuators 316 could be activated in several unique patterns extend the arms 312 so that the rollers 318 contact the wellbore 104. The generated frictional force (as described above) may relay information to the surface 108. For example, one unique pattern of arm extensions (e.g., a pattern of extending and retracting the arms 316 at timed intervals) may be used to acknowledge receipt of a command at the downhole tool from the surface 108. Another unique pattern may signify that the downhole tool was actuated and/or completed an operation. Another unique pattern may signify that the downhole tool had a malfunction.

In an alternative implementation, an indicator sub may include both magnetic elements and arms so that the sub may operate to increase tension on a conveyance in both metallic cased wellbores, as well as non-magnetic cased and uncased wellbores. For example, the indicator sub may function similarly to indicator sub 200 in portions of the wellbore that include metallic casing. In portions of the wellbore that are uncased or include a non-magnetic casing, the indicator sub may function similarly to indicator sub 300. Further, in some aspects, one or more of both indicator sub 200 and indicator 300 may be coupled within a common tool string, thereby allowing data to be conveyed to the terranean surface on a conveyance in both metallic cased wellbores, as well as non-magnetic cased and uncased wellbores.

In some alternative aspects of the indicator sub 300, the rollers 318 may include brakes (e.g., disk-type brakes) that, when actuated, may increase a frictional force between the rollers 318 and the wellbore 104, thereby increasing drag on the downhole tool 103 and the indicator sub 300. For instance, the brake would, when unactuated, allow free rotation of the roller 318 but, when actuated (e.g., on command or at a specified instant), would restrict rotation of the rollers 318.

Figure 4:
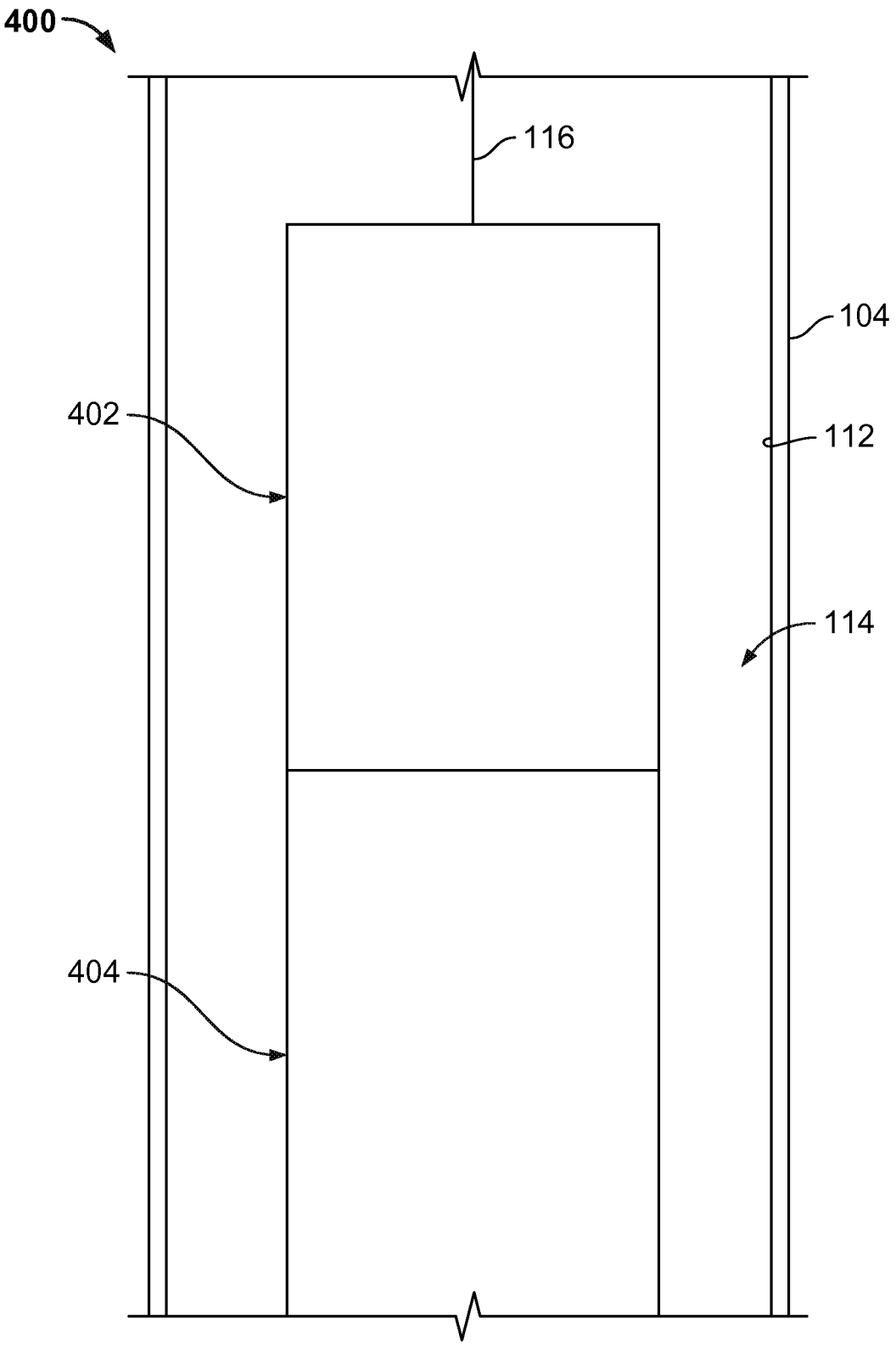
FIG. 4 illustrates an example embodiment of a well tool string that includes an indicator sub and a well tool, such as a triggering sub or perforating tool.

FIG. 4 illustrates an example embodiment of a well tool string 400 that includes an indicator sub 402 and a well tool 404, such as a triggering sub and/or perforating tool. In one example implementation, the well tool string 400 includes the indicator sub 402 and a triggering sub as the well tool 404. In some aspects, the triggering sub may be a battery-operated electronic triggering device that may be used, for example, on slickline perforating operations to trigger perforating guns or other explosive devices. Because it is not always possible to determine if the explosive device was successfully ignited before the guns are brought back to the surface, the triggering sub may have a time out period that must expire before it can be ascertained that the perforating guns are in a safe mode when they are retrieved to the surface. If it cannot be ascertained that the guns went off, then there is a delay to retrieve the tool string to the surface until the triggering sub has gone into safe mode.

In some aspects, the indicator sub 402 may provide for communicating that the triggering sub has gone into safe mode while the tool string 400 is being retrieved to the terranean surface. For example, the indicator sub 402 may be actuated (e.g., as described with reference to indicator sub 200 and/or indicator sub 300) to convey to the surface (e.g., through adjusted and/or variable tension placed on the conveyance for the tool string 400) that the perforating guns have fired and/or the triggering sub is in safe mode. For instance, there could be one activation pattern of tensional pulses that signifies a safe mode (e.g., guns fired) and another to signify live mode (e.g., —guns not fired) so that the surface operator can handle the retrieved tool string 400 accordingly.

In some aspects, the indicator sub 402 and the downhole tool 404 may be separate components in the tool string 400. For example, the indicator sub 402 may include a connection assembly that couples to the tool 404 (e.g., threadingly). In another aspect, although included within the same tool string 400, the indicator sub 402 and the well tool 404 may be separated by one or more tubulars or other well tools in the string 400.

In other aspects, the indicator sub 402 and the downhole tool 404 may be integrated and/or part of a common downhole tool (e.g., within a common housing). Thus, in some aspects, a drag assembly of the indicator sub (e.g., as described above with respect to indicator subs 200 and/or 300) may be in a common housing with the downhole tool that may, in some aspects, provide data to the indicator sub 402 to actuate the drag assembly.

A number of examples have been described. Nevertheless, it will be understood that various modifications may be made. For example, although indicator sub 300 is illustrated as having two arms 316, there may be more or fewer arms. Further, instead of arms, the indicator sub 300 may include bow springs mounted on the housing that, in some aspects, include rollers positioned near a midpoint of the bow springs to contact a wellbore wall or other tubular (e.g., such as a centralizer bow spring assembly). Accordingly, other examples are within the scope of the following claims.

What is claimed is:

1. A well tool, comprising:
a housing;
an electronic controller at least partially enclosed within the housing and adapted to determine a status of a downhole wellbore operation; and
a drag assembly coupled to the electronic controller and, based on the determination of the electronic controller, adapted to engage with a downhole tubular to generate a drag force on the well tool during movement of the well tool through the tubular, the electronic controller operable to selectively control the drag assembly to engage with the downhole tubular to generate a plurality of unique drag forces based on a status of the wellbore operation, the plurality of unique drag forces generated in a substantially repeating pattern.

2. The well tool of claim 1, where the drag assembly comprises a magnetic element positioned near an exterior surface of the housing, the drag assembly adapted to generate a magnetic field near the well tool.

3. The well tool of claim 2, where the magnetic element comprises a permanent magnet, the well tool further comprises a sliding sleeve at least partially attached to the housing and adapted to adjustably expose the permanent magnet in response to the determination of the electronic controller.

4. The well tool of claim 2, where the magnetic element comprises an electromagnet, and the drag assembly further comprises a power conductor that electrically couples the electromagnet to a power source in response to the determination of the electronic controller.

5. The well tool of claim 4, where the power source comprises a battery enclosed within the housing, the battery coupled to the electronic controller.

6. The well tool of claim 1, where the drag assembly comprises:
an extendable arm coupled to the well tool at a proximal end of the arm;
a contact element coupled to a distal end of the arm, the contact element adapted to contactingly engage the tubular; and
an arm actuator communicably coupled to the electronic controller and the arm, the arm actuator adapted to forcibly extend the arm away from the housing.

7. The well tool of claim 6, where the contact element comprises a roller.

8. The well tool of claim 6, where the drag assembly further comprises a power conductor that electrically couples the arm actuator to a power source.

9. The well tool of claim 1, where the electronic controller is operable to selectively control the drag assembly to engage with the downhole tubular to generate a plurality of drag forces on the well tool during movement of the well tool through the tubular based on a status of the wellbore operation.

10. A method of conveying data from a wellbore to a terranean surface, comprising:
identifying, at an indicator sub that is part of a downhole tool string coupled to a conveyance through a wellbore, data that is associated with an operation of a downhole well tool in the tool string;
based on the identification of the data, selectively actuating a drag assembly of the indicator sub according to a substantially repeating pattern comprising a unique sequence of actuation of the drag assembly and non-actuation of the drag assembly; and
adjusting a tension on the conveyance based on actuating the drag assembly as the downhole tool string is moved through the wellbore, the tension associated with the data from the downhole well tool.

11. The method of claim 10, where identifying data that is associated with an operation of the downhole well tool comprises receiving, at the indicator sub, the data from the downhole well tool in the tool string.

12. The method of claim 10, where actuating a drag assembly of the indicator sub comprises:
energizing a magnetic element of the drag assembly;
generating a magnetic field adjacent a housing of the indicator sub; and
attracting the housing of the indicator sub to a ferrous tubular positioned in the wellbore with the generated magnetic field.

13. The method of claim 10, where actuating a drag assembly of the indicator sub comprises:
actuating an arm of the drag assembly based on the receipt of the data;
extending the arm of the drag assembly away from a housing; and
contacting the arm of the drag assembly with a tubular positioned in the wellbore or a surface of the wellbore.

14. The method of claim 13, where contacting the arm of the drag assembly with a tubular positioned in the wellbore or a surface of the wellbore comprises contacting a roller coupled to the arm against the tubular positioned in the wellbore or the surface of the wellbore.

15. The method of claim 10, further comprising:
actuating a brake to apply a force on the drag assembly; and further adjusting the tension on the conveyance based on the applied force on the drag assembly.

16. The method of claim 10, further comprising:

measuring, at the terranean surface, the adjusted tension on the conveyance; and based on the measurement, determining a status of at least a portion of the downhole tool string.

17. A downhole tool assembly, comprising:

a downhole tool configured to perform one or more downhole operations; and an indicator sub comprising:

a controller at least partially enclosed within a housing of the indicator sub and communicably coupled to the downhole tool; and a power source coupled to the controller; and a drag assembly coupled to the power source and adapted to generate a drag force on the downhole tool assembly during movement of the downhole tool assembly through a tubular, the controller operable to selectively control the drag assembly to engage with the tubular to generate a plurality of unique drag forces based on a status of the downhole operations, the plurality of unique drag forces generated in a substantially repeating pattern.

18. The downhole tool assembly of claim 17, where the drag assembly comprises an electromagnet, and the drag assembly further comprises a power conductor that electrically couples the electromagnet to the power source, the electromagnet adapted to generate a magnetic field that attracts the indicator sub to the tubular when the electromagnet is energized by the power source.

19. The downhole tool assembly of claim 17, where the drag assembly comprises:

an actuator; and a member coupled to the housing and extendable to directly contact the tubular when the actuator is powered by the power source.

20. The downhole tool assembly of claim 19, where the member comprises a roller arranged on the member to directly contact the tubular when the actuator is powered.

21. The downhole tool of claim 17, where the indicator sub is integrated with the downhole tool.

* * * * *